US008850750B2

(12) United States Patent
Dagher et al.

(10) Patent No.: US 8,850,750 B2
(45) Date of Patent: Oct. 7, 2014

(54) RAPIDLY-DEPLOYABLE LIGHTWEIGHT LOAD RESISTING ARCH SYSTEM

(75) Inventors: Habib J. Dagher, Veazie, ME (US); Eric N. Landis, Orono, ME (US); Imad W. El Chiti, Tampa, FL (US)

(73) Assignee: University of Maine System Board of Trustees, Bangor, ME (US)

( * ) Notice: Subject to any disclaimer, the term of this patent is extended or adjusted under 35 U.S.C. 154(b) by 1098 days.

(21) Appl. No.: 11/043,420

(22) Filed: Jan. 26, 2005

(65) Prior Publication Data

US 2006/0174549 A1 Aug. 10, 2006

(51) Int. Cl.

| | |
|---|---|
| ***E04B 1/32*** | (2006.01) |
| ***E02D 29/05*** | (2006.01) |
| ***E21D 11/18*** | (2006.01) |
| ***E21D 15/48*** | (2006.01) |
| ***E21D 11/10*** | (2006.01) |
| ***E04B 1/16*** | (2006.01) |

(52) U.S. Cl.

CPC ..... *E02D 29/05* (2013.01); *E21D 11/18* (2013.01); *E04B 1/3205* (2013.01); *E21D 15/483* (2013.01); *E21D 11/10* (2013.01); *E04B 1/168* (2013.01)

USPC ..... 52/86; 52/87

(58) Field of Classification Search

CPC ..... E04B 1/3205; E04G 9/00

USPC ..... 52/86, 87, 88, 169.6

See application file for complete search history.

(56) References Cited

U.S. PATENT DOCUMENTS

| | | | | |
|---|---|---|---|---|
| 2,999,272 A | | 9/1961 | Warnken | |
| 3,104,441 A | | 9/1963 | Smith | |
| 3,111,965 A | | 11/1963 | Hodge | |
| 3,143,155 A | | 8/1964 | Knox | |
| 3,203,143 A | * | 8/1965 | Swenson | 52/64 |
| 3,278,116 A | * | 10/1966 | Petty | 52/750 |
| 3,467,354 A | | 9/1969 | Graham | |

(Continued)

FOREIGN PATENT DOCUMENTS

| | | |
|---|---|---|
| DE | 1139528 B | 11/1962 |
| DE | 3621611 A1 | 1/1988 |

(Continued)

OTHER PUBLICATIONS

Office Action dated Jun. 19, 2009 for Co-pending CIP U.S. Appl. No. 11/642,240.

(Continued)

*Primary Examiner* — Basil Katcheves

(74) *Attorney, Agent, or Firm* — MacMillan, Sobanski & Todd, LLC

(57) ABSTRACT

A rapidly-erectable lightweight load resisting system for the construction of buried arched bridges, tunnels or underground bunkers, has a plurality of lightweight arched tubular support members which are formed of a fiber reinforced polymer material and are substantially oriented in a vertical plane. The lightweight tubular support members are connected by at least one or more lateral force resisting members which are positioned in a direction perpendicular to the vertical plane of the tubular support members, and which are capable of transferring vertical loads to the tubular support members and of providing lateral-load capacity to the load resisting system. The tubular support members are fitted with one or more holes near the top which allows them to be filled with a suitable material to provide additional strength or stiffness.

19 Claims, 13 Drawing Sheets

(56) References Cited

U.S. PATENT DOCUMENTS

| | | | | | |
|---|---|---|---|---|---|
| 3,470,279 | A | | 9/1969 | Abbott | |
| 3,572,002 | A | * | 3/1971 | Nichols | 52/745.07 |
| 3,665,968 | A | | 5/1972 | De Putter | |
| 3,734,670 | A | | 5/1973 | Stickler, Jr. | |
| 3,896,206 | A | | 7/1975 | Beaver et al. | |
| 3,925,942 | A | * | 12/1975 | Hemmelsbach | 52/86 |
| 3,938,922 | A | | 2/1976 | Godley | |
| 3,968,604 | A | | 7/1976 | Hills | |
| 4,068,423 | A | | 1/1978 | Marsh | |
| 4,091,584 | A | | 5/1978 | Brown | |
| 4,158,586 | A | | 6/1979 | Usui | |
| 4,212,621 | A | | 7/1980 | Michelotti | |
| 4,684,567 | A | | 8/1987 | Okamoto et al. | |
| 4,700,514 | A | * | 10/1987 | Reineman | 52/86 |
| 4,722,156 | A | * | 2/1988 | Sato | 52/98 |
| 4,746,471 | A | | 5/1988 | Hale | |
| 4,825,599 | A | | 5/1989 | Swann, Jr. | |
| 4,864,797 | A | * | 9/1989 | Sato et al. | 52/834 |
| 5,245,802 | A | * | 9/1993 | Davis | 52/86 |
| 5,295,335 | A | | 3/1994 | Collier | |
| 5,333,421 | A | * | 8/1994 | McKenna | 52/86 |
| 5,339,574 | A | | 8/1994 | Downing | |
| 5,400,999 | A | | 3/1995 | Pavie | |
| 5,599,599 | A | | 2/1997 | Mirmiran et al. | |
| 5,664,373 | A | | 9/1997 | Downing | |
| 5,791,363 | A | * | 8/1998 | Moses | 135/143 |
| 5,909,984 | A | * | 6/1999 | Matthews | 405/257 |
| 6,026,613 | A | * | 2/2000 | Quiring et al. | 52/63 |
| 6,082,075 | A | | 7/2000 | Rysgaard | |
| 6,123,485 | A | | 9/2000 | Mirmiran et al. | |
| 6,189,286 | B1 | * | 2/2001 | Seible et al. | 52/834 |
| 6,233,826 | B1 | * | 5/2001 | Wycech | 29/897.1 |
| 6,564,513 | B2 | * | 5/2003 | Henbid et al. | 52/86 |
| 6,679,009 | B2 | * | 1/2004 | Hotes | 52/86 |
| 6,719,492 | B1 | * | 4/2004 | Heierli | 405/124 |
| 6,832,454 | B1 | * | 12/2004 | Iyer | 52/223.4 |
| 7,114,305 | B2 | * | 10/2006 | Heierli | 52/745.08 |
| 2006/0174549 | A1 | | 8/2006 | Dagher et al. | |
| 2007/0175577 | A1 | | 8/2007 | Dagher et al. | |

FOREIGN PATENT DOCUMENTS

| | | | |
|---|---|---|---|
| DE | 9216294 | U1 | 4/1993 |
| DE | 20208538 | U1 | 5/2002 |
| JP | 05084841 | | 4/1993 |
| JP | 11-107216 | | 4/1999 |
| JP | 2000120990 | | 4/2000 |

OTHER PUBLICATIONS

International Search Report, European Patent Office, Application No. 06719287.2, Dated Apr. 5, 2012.

International Search Report, Application No. PCT/US2011/53425, Dated Apr. 5, 2012.

Written Opinion of the International Searching Authority, Application No. PCT/US2011/53425, Dated Apr. 5, 2012.

PCT Internation Search Report, Application No. PCT/US11/53420, Dated Apr. 19, 2012.

PCT Written Opinion, Application No. PCT/US11/53420, Dated Apr. 19, 2012.

* cited by examiner

RAPIDLY-DEPLOYABLE LIGHTWEIGHT LOAD RESISTING ARCH SYSTEM

BACKGROUND OF THE INVENTION

This invention relates in general to a rapidly-deployable lightweight tubular arch load resisting system capable of resisting loads both in the vertical and horizontal directions, useful for the rapid construction of buried arched bridges, tunnels, underground storage facilities, hangers, or bunkers, which minimizes the need for heavy construction equipment at the site.

In the past, there have been several types of technologies that have been used in order to construct short and medium span buried arch bridges, as well as some underground storage facilities and tunnels. These structures are typically covered with a soil overburden which receives traffic or other loading.

One technology includes the use of precast concrete structures which are made in one location and then shipped to the construction site. While the precast concrete structures are made skillfully and meet the construction requirements, the use of precast concrete structures adds greatly to the cost since it is expensive to ship and then install the precast concrete structures. While the precast concrete structures are somewhat quick to install, the precast concrete structures are very heavy and require heavy equipment at the site.

Another technology includes the use of cast-in-place concrete structures which are formed at the construction site and then lifted into place by cranes or the like. This cast-in-place technology provides the benefit of not having to ship the structures. On the other hand, the use of cast-in-place is also expensive and time consuming since an on-site concrete plane must be first constructed at the construction site. The cast-in place concrete structures require time-intensive and very expensive erection and removal of formwork, placement of reinforcing bars, and long construction lead times.

Yet another technology includes the use of pipe metallic structures. Metallic pipe structures have reduced life spans due to corrosion. Another drawback is that pipe metallic structures are limited to short spans and light loads.

Each of these existing construction method technologies has significant disadvantages that are overcome by the present invention. In addition to the need for heavy equipment for construction at the site in order to construct and then erect most bridges today, a major drawback that is common to these existing construction technologies is that, while metallic and steel reinforced concrete are widely used and accepted in the construction of many structures, the reinforced concrete structures are susceptible to deterioration. Over time, particularly in northern climates, numerous freeze-thaw cycles and the use of de-icing chemical accelerate corrosion and material degradation. The exposure of the steel reinforced concrete structures to conditions such as water, road salt and the like, and the freezing and thawing thereof, can cause cracks to form in the structures. These cracks, in turn, cause reinforcing steel to corrode and expand, causing further cracking, thereby allowing air and more water to enter the structure, thereby weakening and damaging the structure.

SUMMARY OF THE INVENTION

In one aspect, the present invention relates to a lightweight load resisting system having a network of generally arched hollow tubular main support members which minimize the requirement for heavy construction equipment at the site. In one aspect, the present invention includes a network of arched tubular support members that are juxtaposed to each other.

In another aspect, the present invention includes a network of spaced apart arched tubular support members that are operatively held together. In yet another aspect, both the juxtaposed and spaced apart networks can include flat or corrugated vertical and lateral force resisting members positioned on and attached to the support members.

In yet another aspect, the present invention relates to a load resisting system where the tubular main support members are site-filled with a flowable material such as grout, sand, concrete or the like in order to provide additional strength and stiffness to the load resisting system.

In a particular aspect, the present invention relates to a network load resisting system comprising a plurality of tubular support members for supporting a vertical overburden. In certain embodiments, the load resisting system is especially useful for supporting a soil overburden, such as in a roadway, bridge or underground storage facility, or vehicular loading such as in a bridge.

In certain embodiments, each tubular support member has an opening near a top portion of the tubular support member such that the tubular support members are capable of being site-filled with non-shrink or expansive concrete, nonshrink or expansive grout, or sand via the openings near the top of tubular support members.

The tubular support members are connected in a transverse direction using substantially horizontal rods fitted through transverse holes spaced along the length of each tubular support member.

In certain embodiments, the tubular support members comprise a plurality of longitudinal, substantially parallel, at least partially hollow structural members operatively connected by at least one connector member.

The tubular support members are operatively connected to at least one or more lateral force resisting members. The lateral force resisting members are generally positioned in a direction perpendicular to the tubular support members. The lateral force resisting members are capable of transferring vertical loads to the tubular support members and providing lateral load capacity to the load resisting system. In certain embodiments, the lateral force resisting members comprise corrugated sheets, where the sheet corrugations run in a direction perpendicular to the vertical plane of the tubular support members.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

This invention overcomes many difficulties with existing construction method technologies for constructing buried concrete and metallic arch structures. The present invention is especially useful for construction of such applications as, for example, short-span buried bridges, underground storage facilities, and tunnel structures where the use of lightweight components speeds construction and reduces the requirements for heavy equipment at the construction site.

Thus, in one aspect, this invention relates to a load resisting system having a network of generally arched or bent-shaped tubular support members substantially oriented in a vertical plane for supporting live or dead loads, generally shown in the figures herein as L. It is to be understood that the load L can be, for example, a soil overburden that exerts a force on the load resisting system of the present invention.

In one aspect, the present invention relates to a rapidly-erectable lightweight load resisting system for the construction of buried arched bridges, tunnels or underground bunkers. The rapidly-erectable lightweight load resisting system has a plurality of lightweight arched tubular support members which are formed of a fiber reinforced polymer material and are substantially oriented in a vertical plane such that the tubular support members collectively form the vertical load resisting system. The lightweight tubular support members are connected by at least one or more lateral force resisting members. The lateral force resisting members are positioned in a direction perpendicular to the vertical plane of the tubular support members. The lateral force resisting members are capable of transferring vertical loads to the tubular support members and of providing lateral-load capacity to the load resisting system. The tubular support members have one or more holes near the top, or crown, of the tubular support member which allows the tubular support member to be filled with an expansive grout, expansive polymer, nonshrink concrete, or sand material to provide additional strength or stiffness. Among the key features of the present inventive lightweight system are its transportability, its durability, and its ability to be rapidly erected with minimal equipment needed at the construction site.

In certain other aspects, the support members are operatively connected to at least one or more lateral force resisting members which are generally positioned in a direction perpendicular to a vertical plane defined by the tubular support members such that the lateral force resisting members function to transfer the loads to the tubular support members and to provide lateral load, or racking, strength to the load resisting system.

Figure 1:
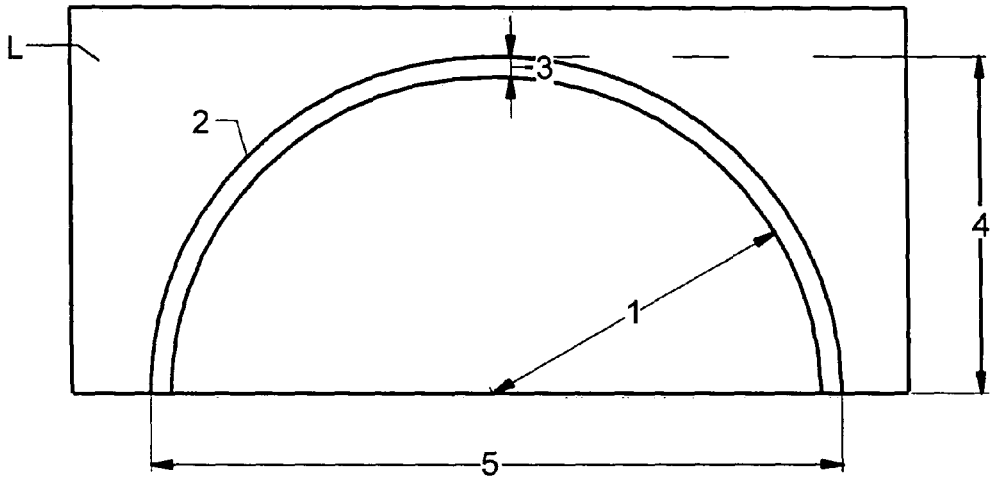
FIG. 1 is a schematic side elevational view of one embodiment of a tubular support member having a first geometry for use in a network load resisting system.

Referring now to the drawings, there is illustrated in FIG. 1 a schematic illustration of a load L being supported by a first embodiment of a generally arched tubular support member 2 that has a generally uniform radius 1. The tubular support member 2 is hollow and has a defined inner cross-sectional dimension 3. The generally uniform radius 1 thereby provides the tubular support member 2 with a predetermined height 5 and a predetermined length 5. It is to be understood that the specific dimensions of the inner cross-sectional dimension, the radius, the height and the length of the tubular support member 2 are guided by the end use application for which the tubular support member is being used, as will be fully described herein. For example, the hollow tubular support member 2 can have a generally circular, square, rectangular, trapezoidal or other useful structural configuration, and as such, the inner cross-sectional dimension 3 will, therefore, define at least one of the diameter, inner length or width of the tubular support member 2. Also, it is within the contemplated scope of the present invention that the inner cross-sectional dimension can vary along an arched length of the tubular support member such that the tubular support member can have a varied thickness that corresponds to the needs of the end use application. In certain end use applications, it may be desired that lower portions of the tubular support member adjacent the ground are thicker in order to support upper portions of the tubular support member.

Figure 2:
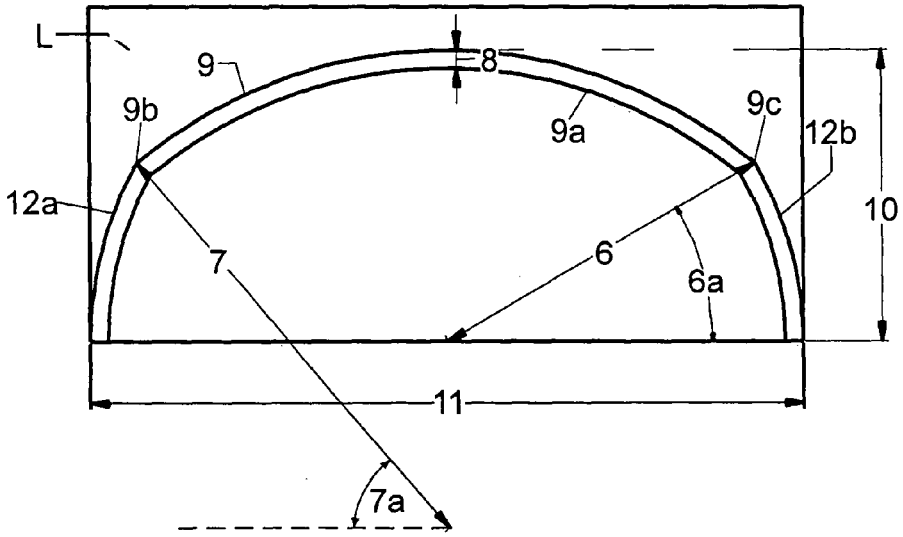
FIG. 2 is a schematic side elevational view of one embodiment of a tubular support member having a second geometry for use in a network load resisting system.

FIG. 2 shows a schematic illustration of a load L being supported a second embodiment of a generally arched tubular support member 9 having a first radius 6, which defines angle 6*a*, and a second radius 7, which defines angle 7*a*. The tubular support member 9 includes a first arched structural section 9*a* which is in communication with a second arched structural section 12*a* on a first end 9*b* thereof. The first arched structural section 9*a* is in communication with a third arched structural section 12*b* on a second end 9*c* thereof. The tubular support member 9 is hollow and has a defined inner cross-sectional dimension 8. The first arched structural section 9*a* has an arched dimension that is defined by the first radius 6 and by angle 6*a*, while the second and third arched structural sections 12*a* and 12*b*, respectively, have arched dimensions that are defined by the second radius 7 and by angle 7*a*. The combination of the first and second radii 6 and 7, respectively, thereby provide the tubular support member 9 with a predetermined height 10 and a predetermined length 11. By varying the lengths of the first radius 6 and the second radius 7, the height 10 and the width 11 of the tubular support member 9 are altered.

Figure 3:
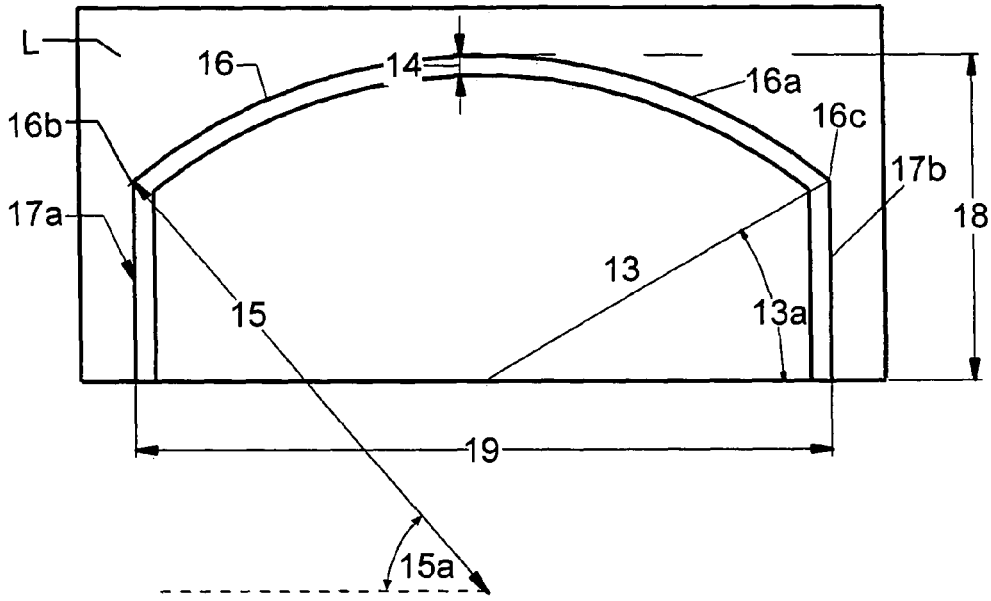
FIG. 3 is a schematic side elevational view of one embodiment of a tubular support member having a third geometry for use in a network load resisting system.

FIG. 3 shows a schematic illustration of a load L being supported a third embodiment of a tubular support member 16 having a first radius 13, which defines angle 13*a*, and a second radius 15, which defines angle 15*a*. The tubular support member 16 includes a first arched structural section 16*a* which is in communication with a first generally straight structural section 17*a* on a first end 16*b* thereof and which is in communication with a second generally straight structural section 17*b* on a second end 16*c* thereof. The tubular support member 16 is hollow and has a defined inner cross-sectional dimension 14. The arched structural section 16*a* has an arched dimension that is defined by the first radius 13 and by the angle 13*a*, while the second and third arched structural sections 12*a* and 12*b*, respectively, have arched dimensions that are defined by the second radius 15 and by the angle 15*a*. The combination of the first and second radii 13 and 15, respectively, thereby provide the tubular support member 16 with a predetermined height 18 and a predetermined length 19. By varying the lengths of the first radius 13 and the second radius 15, the height 18 and the width 19 of the tubular support member 16 are altered.

Figure 4:
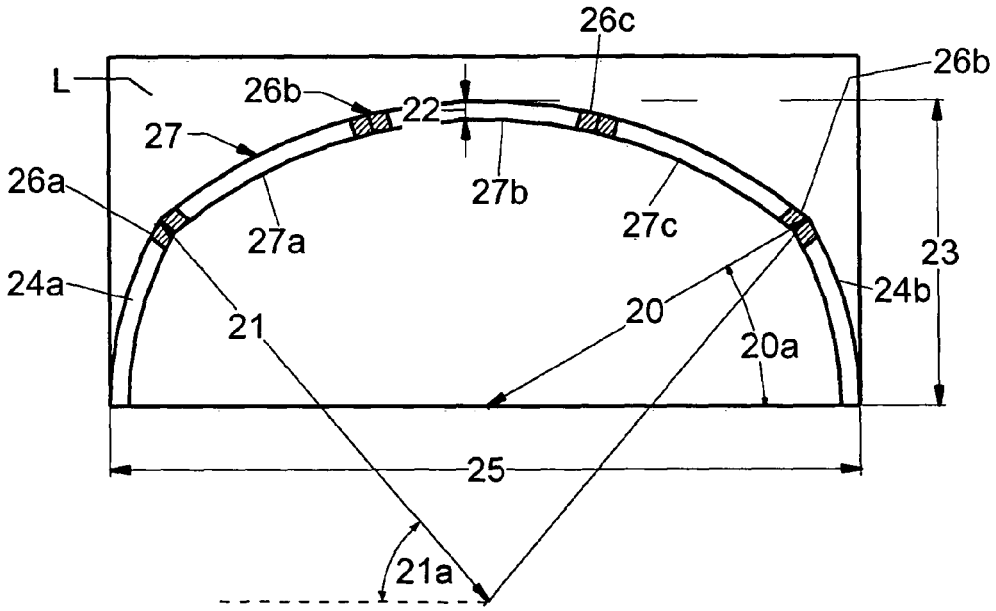
FIG. 4 is a schematic side elevational view of one embodiment of a tubular support member having a fourth geometry for use in a network load resisting system.

FIG. 4 shows a schematic illustration of a load L being supported a fourth embodiment of a generally arched tubular support member 27 having a first radius 20, which defines angle 20*a*, and a second radius 21, which defines angle 21*a*. The tubular support member 27 includes a plurality of arched structural sections 27*a*, 27*b* and 27*c*. It is to be understood that fewer or more arched structural sections can be included, and that the number of such arched structural sections, depends, at least, in part on the dimensions of the end use application. In the embodiment shown, the first arched structural section 27*a* is in communication with a fourth arched structural section 24*a* at a first end 27*d* on the first arched structural section 27*a*. The third arched structural section 27*c* is in communication with a fifth arched structural section 24*b* at a first end 27*e* on the third arched structural section 27*c*. The structural member 27 is hollow and has a defined inner cross-sectional dimension 22. The first, second and third arched structural sections 27*a*, 27*b* and 27*c*, respectively, define an arched dimension that is defined by the first radius 20 and by angle 20*a*. The fourth and fifth arched structural sections 24*a* and 24*b*, respectively, have arched dimensions that are defined by the second radius 21 and by angle 21*a*. The combination of the first and second radii 20 and 21, respectively, thereby provide the tubular support member 27 with a predetermined height 23 and a predetermined length 25. By varying the lengths of the first radius 20 and the second radius 21, the height 23 and the width 25 of the tubular support member 27 are altered. The embodiment shown in FIG. 4 includes a plurality of connector members which are operatively connected to adjacent ends of the arched structural sections; that is a first connector member 26*a* operatively connects the fourth arched structural section 24*a* to the first arched structural section 27*a*; a second connector member 26*b* operatively connects the first arched structural section 27*a* to the second arched structural section 27*b*; a third connector member 26*c* operatively connects the second arched structural section 27*b* to the third arched structural section 27*c*; and, a fourth connector member 26*d* operatively connects the third arched structural section 27*c* to the fifth arched structural section 24*b*. Thus, the use of connector members allows the tubular support member 27 to be brought to the installation site in pieces, or short structural sections, and assembled in an easy manner.

Figure 5:
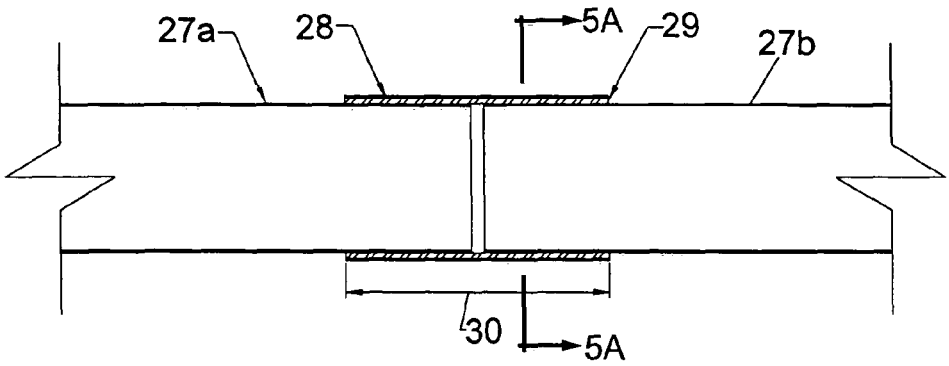
FIG. 5 is a schematic side elevational view, partially in cross section, of a first connector member for use with a structural member for use in a network load resisting system.
Figure 5A:
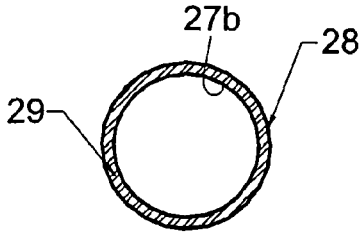
FIG. 5A is a cross sectional view taken along the line 5A-5A in FIG. 5.

FIGS. 5 and 5A show one type of useful connector member 28 which has an interior diameter 29 that is coextensive or slightly larger than the outer diameters of the structural sections 27*a* and 27*b*. The connector member 28 has a preferred length 30 such that adjacent ends of the structural sections 27*a* and 27*b* are securely held within the connector member 28.

Figure 6:
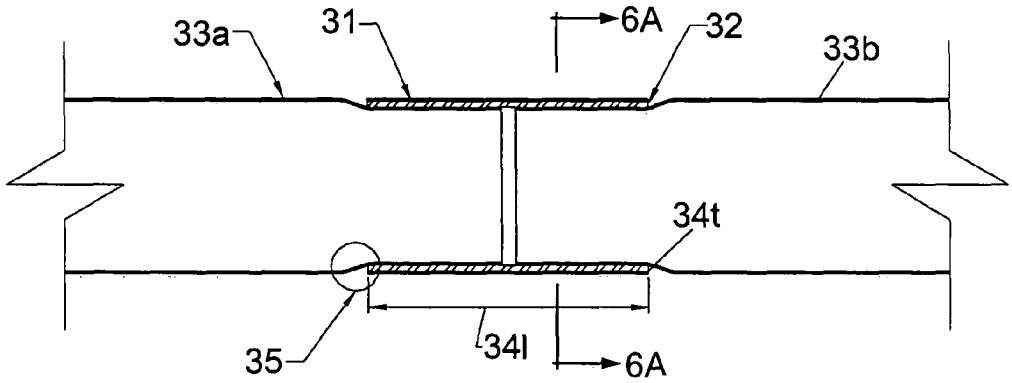
FIG. 6 is a schematic side elevational view, partially in cross section, of a second connector member for use with a structural member for use in a network load resisting system.
Figure 6A:
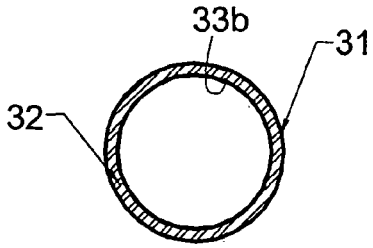
FIG. 6A is a cross sectional view taken along the line 6A-6A in FIG. 6.

FIGS. 6 and 6A show another type of useful connector member 31 which has an interior diameter 32 and other embodiments of adjacent structural sections 33*a* and 33*b*. The structural sections 33*a* and 33*b* each define ends that include a necking, or tapered, region 35. In the embodiment shown in FIGS. 6 and 6A, the interior diameter 32 of the connector member 31 is coextensive or slightly larger than an outer diameters tapered region 35 of the structural sections 33*a* and 33*b*. The connector member 31 has a preferred length 341 such that adjacent ends of the structural sections 33*a* and 33*b* are securely held within the connector member 31. The connector member 31 also has a preferred thickness 34*t* such that, when the connector 31 is telescopingly positioned on the ends of the adjacent structural sections 33*a* and 33*b*, the outer diameter of the connector member 31 is in the same plane as defined by the outer diameter of the structural sections 33*a* and 33*b*. This embodiment thereby allows multiple tubular support members (comprised of, for example, the structural sections 33*a* and 33*b*) to be positioned in touching engagement, as will be further explained below.

Figure 7:
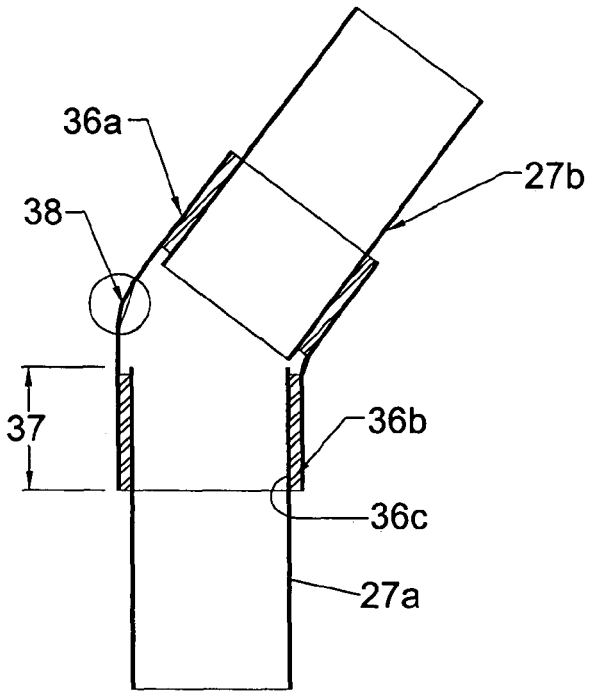
FIG. 7 is a schematic side elevational view, partially in cross section, of a third connector member for use with a structural member for use in a network load resisting system.

FIG. 7 shows another type of useful connector elbow member 36 that has first and second sections 36*a* and 36*b* that have axes that are not coincident. The elbow connector member 36 has an interior diameter 36*c* that is coextensive with, or slightly larger than, the outer diameters of the structural sections 27*a* and 27*b*. The connector member 36 has a preferred length 38 such that adjacent ends of the structural sections 27*a* and 27*b* are securely held within the connector member 36.

Figure 8:
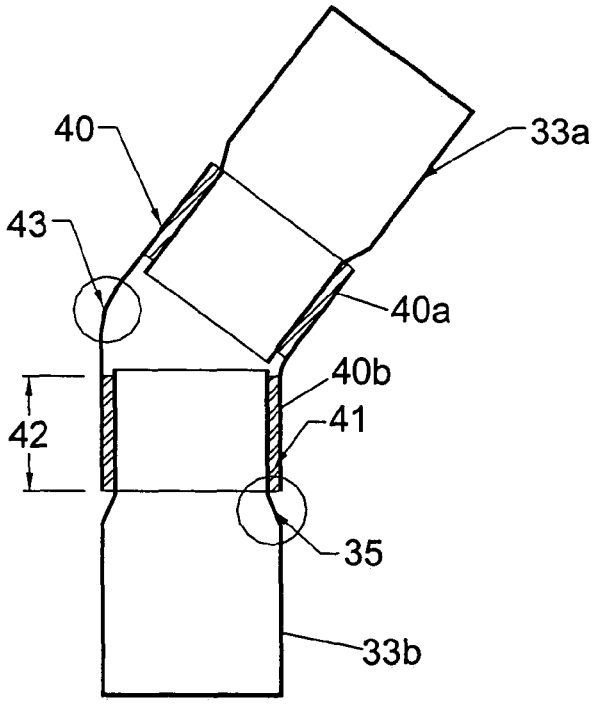
FIG. 8 is a schematic side elevational view, partially in cross section, of a fourth connector member for use with a structural member for use in a network load resisting system.

FIG. 8 shows another type of useful elbow connector member 40 that has first and second sections 40*a* and 40*b* that have axes that are not coincident. The elbow connector member 40 has an interior diameter 40*c* that is coextensive with, or slightly larger than, the outer diameters of the necking, or tapered, region 35. In the embodiment shown in FIG. 8, the interior diameter 32 of the connector member 40 is coextensive or slightly larger than the outer diameter of the tapered region 35 of the structural sections 33*a* and 33*b*. Each section 40*a* and 40*b* of the connector member 40 has a preferred length 42 such that adjacent ends of the structural sections 33*a* and 33*b* are securely held within the connector member 40. The connector member 40 also has a preferred thickness 41 such that, when the connector member 40 is telescopingly positioned on the ends of the adjacent structural sections 33*a* and 33*b*, the outer diameter of the connector member 40 is in the same plane as defined by the outer diameter of the structural sections 33*a* and 33*b*. This embodiment thereby allows multiple structural members (comprised of the structural sections 33*a* and 33*b*) to be positioned in touching engagement, as will be further explained below.

Figure 9:
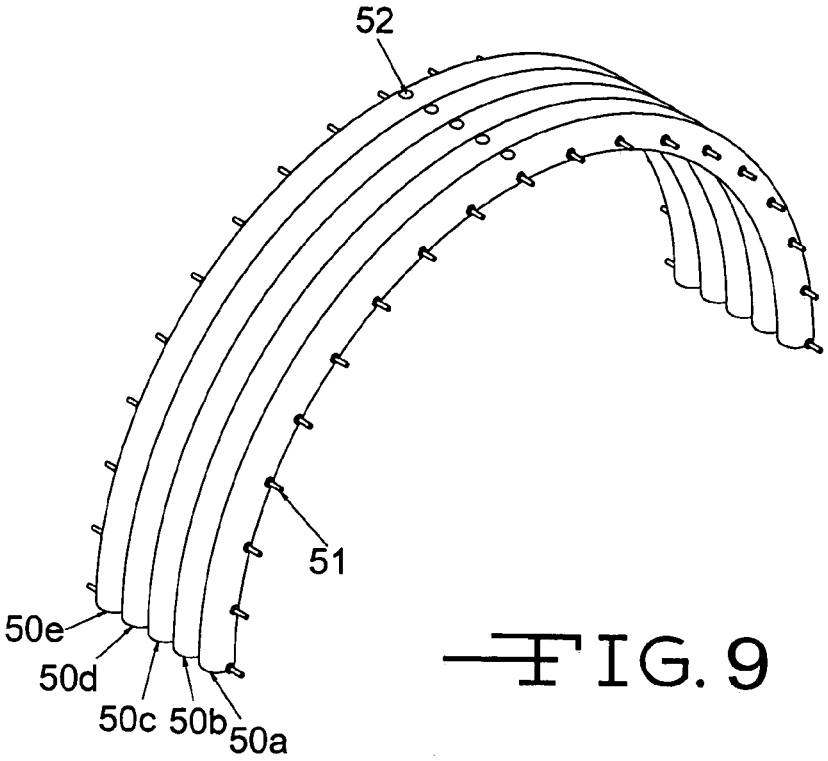
FIG. 9 is a schematic perspective view of a plurality of tubular support members in a juxtaposed, or adjacent, configuration for use in a network load resisting system.
Figure 10:
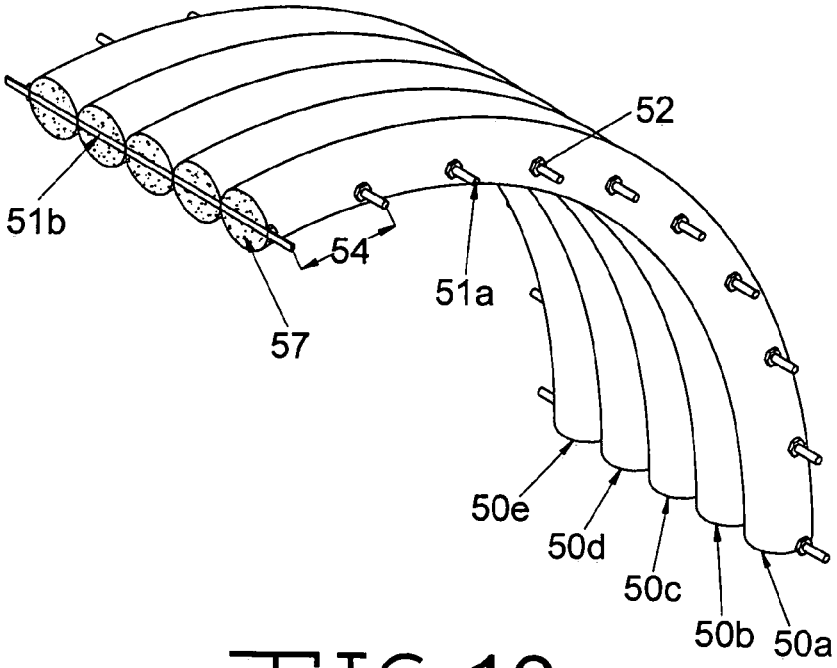
FIG. 10 is a broken-away, schematic perspective view of a plurality of tubular support members in a juxtaposed, or adjacent, configuration for use in a network load resisting system.

In one aspect, as shown in FIG. 9 and FIG. 10, the load resisting system includes a network of generally arched or bent-shaped tubular support members, generally shown as 50*a*, 50*b*, 50*c*, 50*d*, and 50*e* for supporting live or dead loads. It is to be understood that the load resisting system can include fewer of more tubular support members and that the depiction of the five adjacent tubular support members is shown for ease of explanation. The network of the tubular support members 50*a*, 50*b*, 50*c*, 50*d*, and 50*e* collectively form a main load resisting system which, for example, receives a load such as a soil overburden to form a roadway or a bridge or an underground storage facility.

In certain embodiments, the load resisting system includes a plurality of cross extending rods 51, such as dowels, rebar or fiberglass. Each rod 51 is positioned to extend through radially extending openings 52 in the tubular support members 50*a*, 50*b*, 50*c*, 50*d*, and 50*e*. In certain embodiments, a nut can be coaxially positioned adjacent outermost openings 52 in the network of tubular support members 50*a*, 50*b*, 50*c*, 50*d*, and 50*e*. In one embodiment, the longitudinal tubular support members 50*a*, 50*b*, 50*c*, 50*d*, and 50*e* are placed parallel to traffic in a bridge end use application. Each rod 51 can be positioned at a distance 54 from an adjacent 51, as shown in FIG. 10; or, alternatively, the rods 51 can be spaced at differing distances, depending upon the end use requirements for reinforcement and stiffness.

In certain embodiments, each tubular support member 50*a*, 50*b*, 50*c*, 50*d*, and 50*e* includes at least one opening 52 through which the tubular support members 50*a*, 50*b*, 50*c*, 50*d*, and 50*e* may be filled with a reinforcing material 57 at the construction site in order to provide additional strength and stiffness to the structural members 50*a*, 50*b*, 50*c*, 50*d*, and 50*e*.

Figure 11:
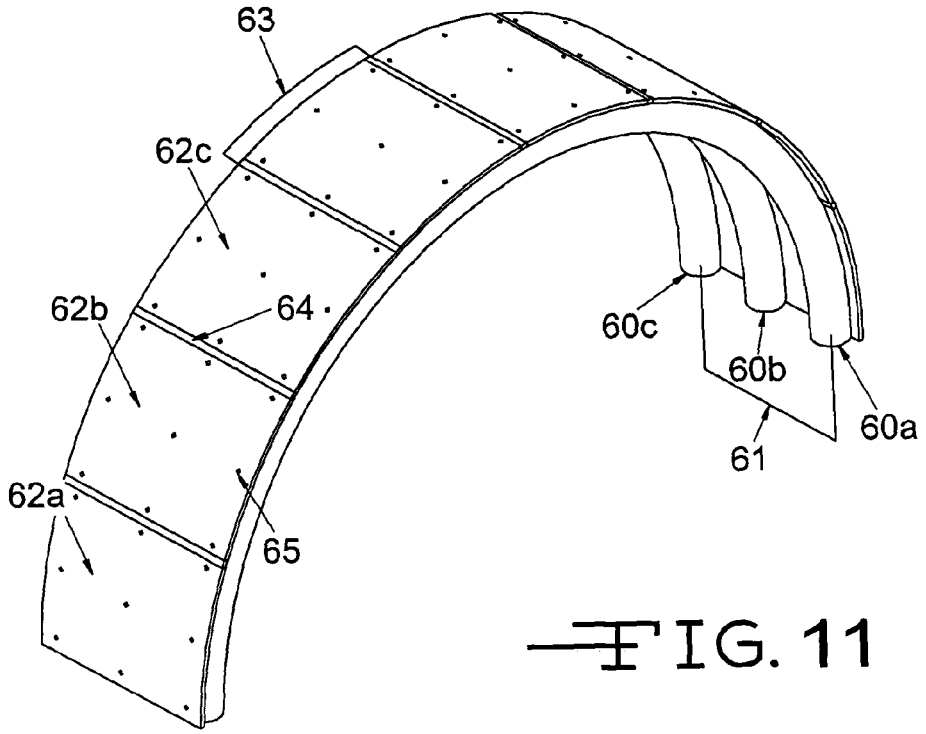
FIG. 11 is a schematic perspective view of a plurality of tubular support members in a spaced-apart configuration, having a lateral force resisting system thereon, for use in a network load resisting system.

In another embodiment, as shown in FIG. 11, the load resisting system includes a network of generally spaced apart arched or bent-shaped tubular support members, generally shown as 60*a*, 60*b* and 60*c* for supporting live or dead loads. It is to be understood that the load resisting system can include fewer or more tubular support members and that the depiction of the three tubular support members spaced apart at a distance 61 is shown for ease of explanation.

In certain embodiments, the load resisting system includes plurality of lateral force resisting members 62*a*, 62*b*, 62*c*, etc. which are in a spaced-apart configuration on an outer surface of the spaced apart tubular support members 60*a*, 60*b* and 60*c*. In certain embodiments, the first lateral force resisting member 62*a* is positioned at a distance 64 from the second force resisting member 62*b*. Each lateral force resisting member 62*a*, 62*b* and 62*c* has a preferred width 63 such that each lateral force resisting member 62*a*, 62*b* and 62*c* can be easily positioned on the network of tubular support members 60*a*-60*c*. The force resisting members 62*a*, 62*b* and 62*c* are secured to the tubular support members 60*a*-60*c* by a plurality of suitable fasteners 65. The network of the tubular support members 60*a*, 60*b* and 60*c* and the lateral force resisting members 62*a* etc. collectively form a main load resisting system which receives a load such as a soil overburden to form a roadway or a bridge or an underground storage facility.

Figure 12:
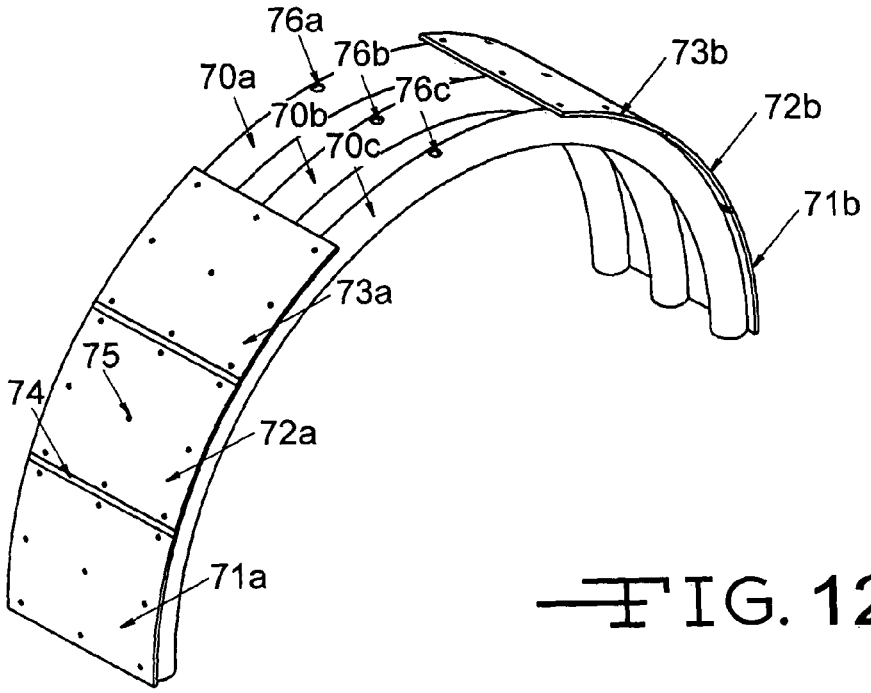
FIG. 12 is a schematic perspective view of a plurality of tubular support members in a spaced-apart configuration, showing several lateral force resisting members positioned on the tubular support members, for use in a network load resisting system.

In another aspect, as shown in FIG. 12, the load resisting system includes a network of generally spaced apart arched or bent-shaped tubular support members, generally shown as 70*a*, 70*b* and 70*c* for supporting live or dead loads. It is to be understood that the load resisting system can include fewer or more tubular support members and that the depiction of the three tubular support members spaced apart at the shown distance is done for ease of explanation, and that the space between each tubular support members depends upon the load to be borne. In certain embodiments, the load resisting system includes plurality of lateral force resisting members 71*a*, 71*b*, 72*a*, 72*b*, 73*a*, 73*b*, etc. which are in a spaced-apart configuration on an outer surface of the spaced apart tubular support members 70*a*-70*c*. In certain embodiments, the network is assembled wherein the first lateral force resisting members 71*a* is positioned on a first end of the tubular support members 70*a*-70*c*; thereafter the lateral force resisting members 71*b* is positioned on a second end of the tubular support members 70*a*-70*c*. Subsequent assembly includes the sequential placement of lateral force resisting members 72*a*, then 72*b*, 73*a*, 73*b*, and so on such that the lateral force resisting members are positioned in an alternating manner on the tubular support members. In certain embodiments, each lateral force resisting member is positioned at a distance 74 from an adjacent lateral force resisting member. The lateral force resisting members 71*a*-73*b* etc. are secured to the tubular support members 70*a*-70*c* by a plurality of suitable fasteners 75. In certain aspects, each tubular support member 70*a*-70*c* includes at least one opening 76*a*, 76*b* and 76*c*, respectively, through which the tubular support members 70*a*-70*c* may be filled with a suitable reinforcing material 57 at the construction site in order to provide additional strength and stiffness to the tubular support members 70*a*-70*c*.

Figure 13:
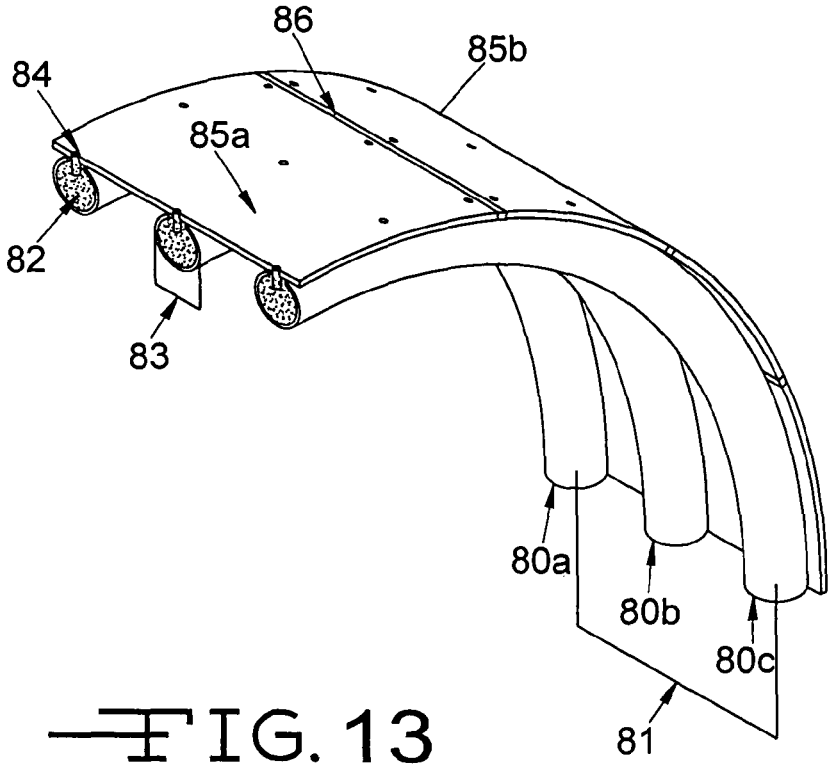
FIG. 13 is a broken-away, schematic perspective view of a plurality of tubular support members in a spaced-apart configuration, having a lateral force resisting system thereon, for use in a network load resisting system.

In another aspect, as shown in FIG. 13, the load resisting system includes a network of generally spaced apart arched or bent-shaped tubular support members, generally shown as 80*a*, 80*b* and 80*c* for supporting live or dead loads. It is to be understood that the load resisting system can include fewer or more tubular support members and that the depiction of the three tubular support members spaced apart at a distance 81 is shown for ease of explanation. In certain embodiments, the load resisting system includes plurality of lateral force resisting members 85 which are in a spaced-apart configuration on an outer surface of the spaced apart tubular support members 80*a*-80*c*. In certain embodiments, the first lateral force resisting members 85*a* is positioned at a distance 86 from an adjacent lateral force resisting members 85*b*. Each lateral force resisting member 85 has a preferred width such that each lateral force resisting member 85 can be easily positioned on the network of tubular support members 80*a*-80*c*. The lateral force resisting members 85*a* etc. are secured to the tubular support members 80*a*-80*c* by a plurality of suitable fasteners 84 which extend into the reinforcement material 82 in the tubular support member. Each tubular support member 80*a*, 80*b* and 80*c* has a preferred diameter 83 which is determined, at least in part, by the end use application.

Figure 14:
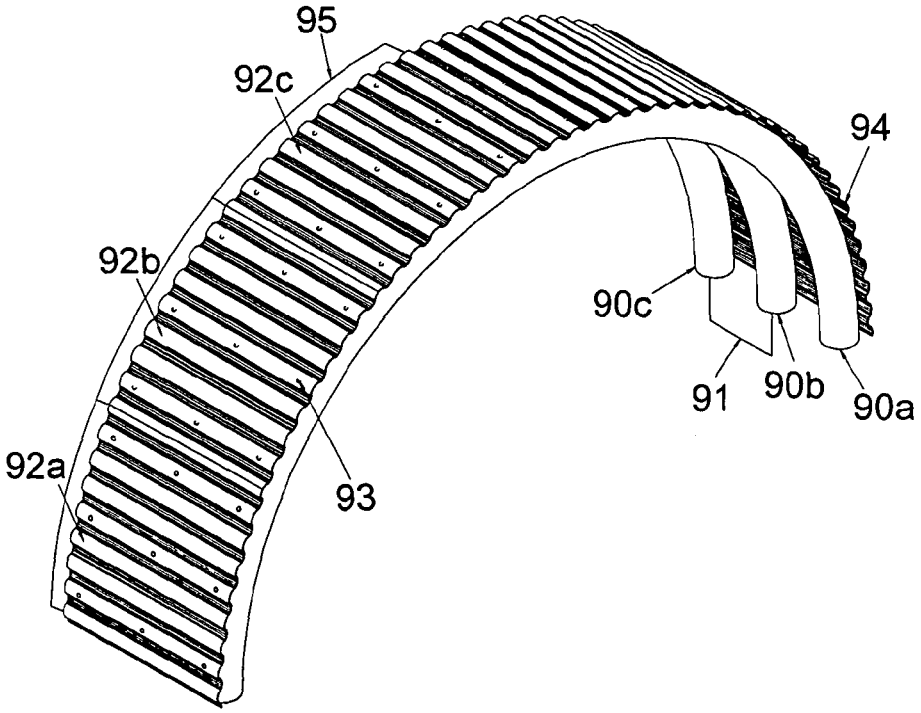
FIG. 14 is a schematic perspective view of a plurality of tubular support members in a spaced-apart configuration, having a lateral force resisting system thereon, for use in a network load resisting system.

In another aspect, as shown in FIG. 14, the load resisting system includes a network of generally spaced apart arched or bent-shaped tubular support members, generally shown as 90*a*, 90*b* and 90*c* for supporting live or dead loads. It is to be understood that the load resisting system can include fewer or more tubular support members and that the depiction of the three tubular support members spaced apart at a distance 91 is shown for ease of explanation. In certain embodiments, the load resisting system includes plurality of corrugated lateral force resisting members 92*a*, 92*b*, 92*c* etc. which are in a spaced-apart configuration on an outer surface of the spaced apart tubular support members 90*a*-90*c*. The corrugated lateral force resisting members 92*a* etc. allow for easy construction since the corrugated resisting members are easy to bend and provide a desired high strength in the direction from arch to arch, thereby providing stiffness in a direction perpendicular to the arch. In certain embodiments, the first lateral force resisting members 92*a* is positioned at immediately adjacent the second lateral force resisting member 92*b*. Each lateral force resisting member 92*a* etc. has a preferred width 95 such that each lateral force resisting member 92 can be easily positioned on the network of tubular support members 90*a*-90*c*. The lateral force resisting members 92*a* etc. are secured to the tubular support members 90*a*-90*c* by a plurality of suitable fasteners 93.

Figure 15:
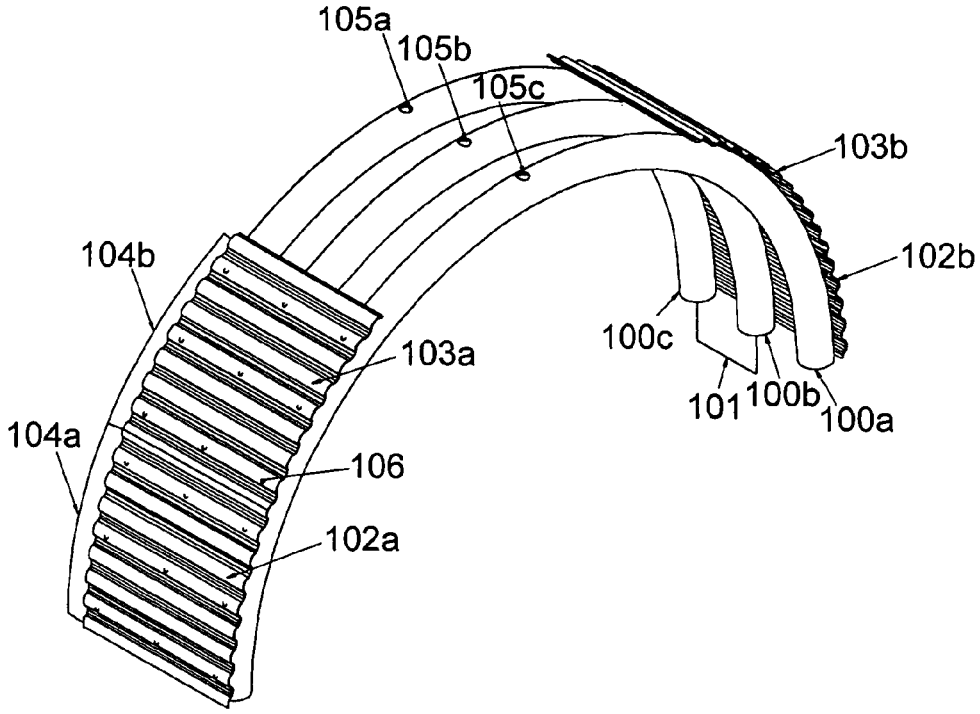
FIG. 15 is a schematic perspective view of a plurality of tubular support members in a spaced-apart configuration, showing several lateral force resisting members positioned on the structural members, for use in a network load resisting system.

In another aspect, as shown in FIG. 15, the load resisting system includes a network of generally spaced apart arched or bent-shaped tubular support members, generally shown as 100*a*, 100*b* and 100*c* for supporting live or dead loads. It is to be understood that the load resisting system can include fewer or more tubular support members and that the depiction of the three tubular support members spaced apart at the distance 101 is done for ease of explanation, and that the space between each tubular support members depends upon the load to be borne. In certain embodiments, the load resisting system includes plurality of lateral force resisting members 102*a*, 102*b*, 103*a*, 103*b*, etc. which are in a spaced-apart configuration on an outer surface of the spaced apart tubular support members 100*a*, 100*b* and 100*c*. In certain embodiments, the network is assembled wherein the first lateral force resisting members 102*a* is positioned on a first end of the tubular support members 100*a*-100*c*; thereafter the second lateral force resisting members 102*b* is positioned on a second end of the tubular support members 100*a*-100*c*. Subsequent assembly includes the alternating and sequential placement of lateral force resisting members 103*a*, then 103*b* and so on. In certain embodiments, each lateral force resisting member is positioned immediately adjacent the next lateral force resisting member. The lateral force resisting members 102*a*-103*b* etc. are secured to the structural members 100*a*-100*c* by a plurality of suitable fasteners 106. In certain aspects, each structural member 100*a*-100*c* includes at least one opening 105*a*, 105*b* and 105*c*, respectively, through which the tubular support members 100*a*-100*c* may be filled with a suitable reinforcing material at the construction site in order to provide additional strength and stiffness to the structural members 100*a*-100*c*.

Figure 16:
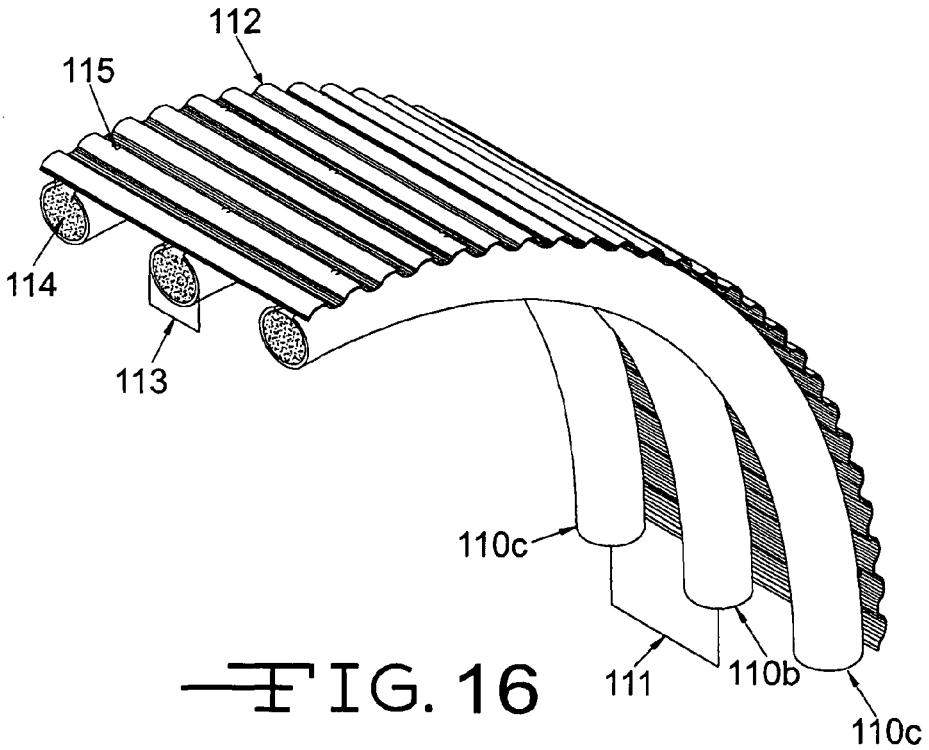
FIG. 16 is a broken-away, schematic perspective view of a plurality of tubular support members in a spaced-apart configuration, having a lateral force resisting system thereon, for use in a network load resisting system.

In another aspect, as shown in FIG. 16, the load resisting system includes a network of generally spaced apart arched or bent-shaped tubular support members, generally shown as 110*a*, 110*b* and 110*c* for supporting live or dead loads. It is to be understood that the load resisting system can include fewer or more tubular support members and that the depiction of the three tubular support members spaced apart at a distance 111 is shown for ease of explanation. In certain embodiments, the load resisting system includes a generally continuous lateral force resisting members 112 is position on an outer surface of the spaced apart tubular support members 110*a*-110*c*. The generally continuous lateral force resisting member 112 is secured to the tubular support members 110*a*-110*c* by a plurality of suitable fasteners 115 which extend into the reinforcement material 114 in the tubular support members. Each tubular support members 110*a*, 110*b* and 110*c* has a preferred diameter 113 which is determined, at least in part, by the end use application.

In one aspect of the present invention, the tubular support members are made of a fiber-reinforced polymer (FRP) composite matrix. The FRP matrix may comprise a thermosetting resin, including but not limited to, at least one of epoxies, vinyl esters, polyesters, phenolics, or urethanes. The FRP matrix may also comprise a thermoplastic resin including, but not limited to, at least one of polypropylenes, polyethylenes, PVCs, or acrylics. The FRP reinforcement may comprise, but not be limited to fiberglass, carbon fiber, aramid fibers or a combination of one or more of these types of fibers. Fiber reinforced polymer composite tubular support members may be manufactured using a variety of processes, including but not limited to resin infusion (Vacuum-Assisted Resin Transfer Molding) or filament winding over a curved mold, or other suitable methods. The fiber forms may be, but are not limited to, stitched, woven or braided fabrics. The wall thickness and the diameter of each tubular support member are such that the tubular support members support the self-weight of the load resisting system and the weight of the material infill. For example, when concrete is used, the composite tubular support member/concrete section is designed to carry the soil overburden and any additional gravity dead or live loading.

In certain aspects, the reinforcing material infill can comprise at least one of non-shrink or expansive wet concrete, nonshrink or expansive grout, and/or sand.

In yet another aspect, the tubular support members can be covered with a flexible fabric, such as a geomembrane or other suitable geotextile. The load resisting system is then backfilled with a suitable material, such as sand, soil, or the like.

In other aspect, the lateral force resisting members are fastened to the tubular support members via screws or other suitable fasteners. The lateral force resisting members and fasteners together function to transfer the loads to the tubular support members and provide lateral load, or racking, strength to the load resisting system of the present invention. In certain embodiments, the lateral force resisting members comprise a flexible flat or corrugated sheet including but not limited to corrugated metal sheets, FRP, extruded PVC, polycarbonate, and wood-plastic composite. In certain embodiments, the sheet corrugations of the lateral force resisting members run in the direction perpendicular to the tubular support members.

In yet another aspect, the present invention relates to a method for building a load resisting system such as a bridge or tunnel which includes erecting longitudinal, substantially parallel, at least partially curved hollow tubular support members where each tubular support members forms an arch substantially oriented in a plane. As the tubular support members are being erected, the tubular support members are temporarily braced and spaced at a prescribed distance from one another. Starting at the low end of the tubular support members, the tubular support members are at least partially covered with a plurality of lateral force resisting members. In certain embodiments, the lateral force resisting members are corrugated sheets which are positioned such that the sheet corrugations run in the direction perpendicular to the tubular support members. The lateral force resisting members are operatively connected to the tubular support members via screws or other fasteners. In certain embodiments, the tubular support members are substantially filled with a suitable reinforcing material via at least one opening near the crown of the tubular support members. Also, in certain embodiments, vibration can be applied to the tubular support members to facilitate proper and complete filling of the tubular support members. Suitable construction supports such as wingwalls and the like are then attached to the load resisting system, and, as may be necessary, and the load resisting system is backfilled with soil to a required depth and paved.

In yet another aspect, the present invention relates to a method for building a load resisting system such as a bridge or tunnel which comprises first assembling a plurality of short arch segments into longer curved hollow tubular support members, then continuing with the method as described above.

Figure 17:
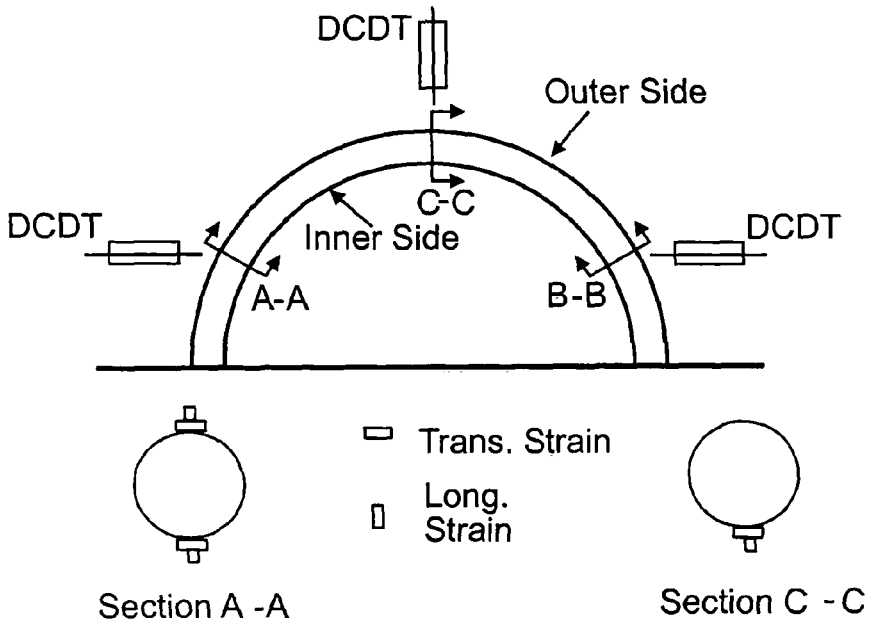
FIG. 17 is a schematic illustration of an instrumentation plan structural load test setup.
Figure 18:
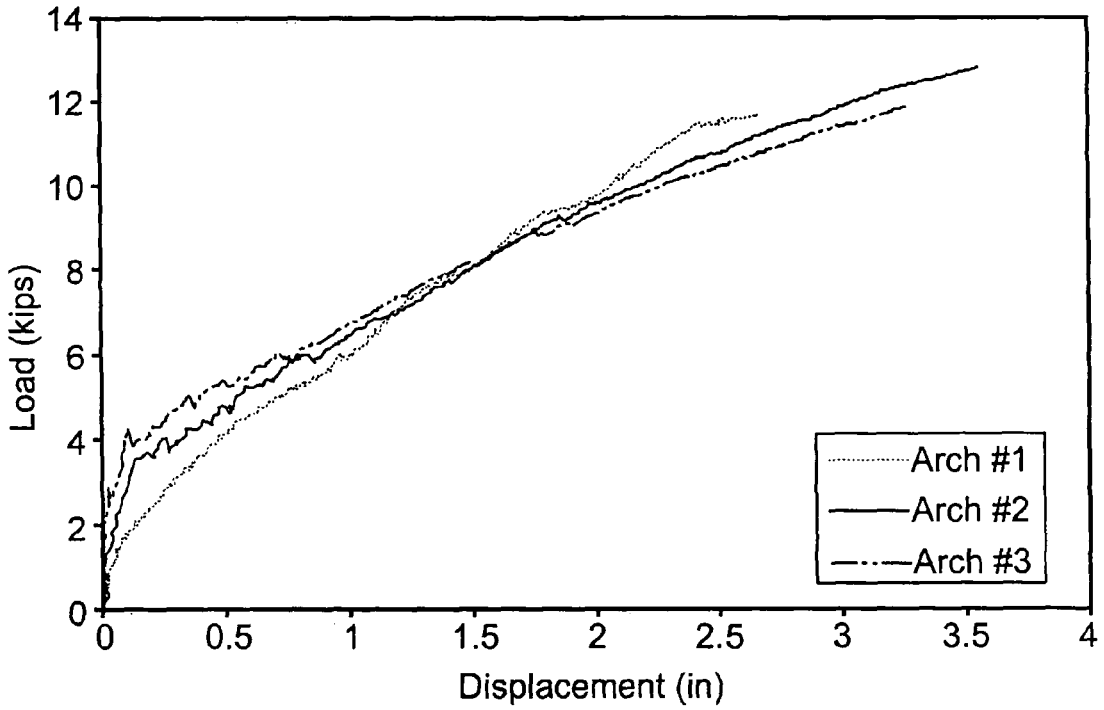
FIG. 18 is a graph depicting Load (kips) versus Displacement (in) for load-deflections obtained through full-scale structural load testing.
Figure 19:
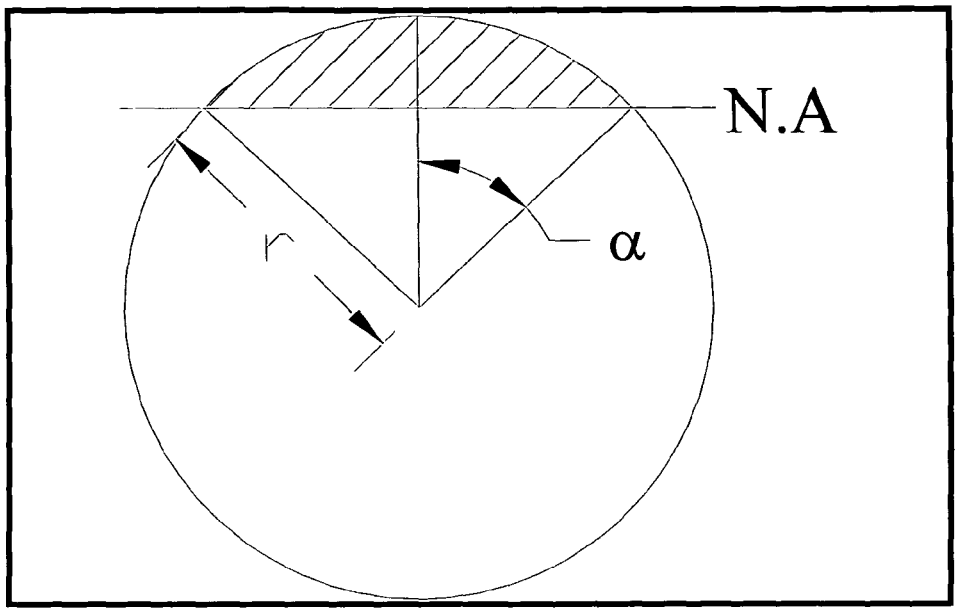
FIG. 19 is a schematic illustration useful for computing the area and inertia of a cracked cylinder section.

FIG. 17 shows the instrumentation plan and full-scale arch structural load test setup used to verify and validate the design assumptions. FIG. 18 is a graph that provides the test results in the form of load-deflections obtained through full-scale structural load testing of the arch. The load is applied at midspan of the concrete-filled arch, and the deflection is measured at midspan.

EXAMPLES

Analysis and Design

In one example, the arch tubes of this invention are designed, by illustrating the design of 15 ft (4.6 m), 7 in. (178 mm) concrete-filled FRP arch tube, under the following conditions:

1. The empty FRP arch tube is checked against dead load stresses developed by the weight of wet concrete.
2. Calculation of maximum concentrated vertical load at midspan, which requires an iterative analysis. A moment-curvature numerical model is used to calculate the ultimate moment capacity of the 7 in. (178 mm) diameter FRP-concrete composite section. The critical concentrated applied loads required to achieve this ultimate moment are determined using a conventional structural analysis model.
3. Global buckling is checked under two cases:
   a. Prior to the curing of concrete
   b. After curing of concrete and application of the concentrated load at midspan.

Local wall buckling is also checked.

1. Check FRP Arch Tubes under Weight of Wet Concrete

The FRP arch tube is modeled using a structural analysis computer program while applying a vertical uniformly distributed load equivalent to the weight of wet concrete along the length of the structure. The arch may be meshed with straight beam elements. The boundary conditions may be taken as pin supports. The area, 1.398 $in^2$ (9.0 $cm^2$), moment of inertia, 8.717 $in^4$ (363 $cm^4$), and the modulus of elasticity, $1.795\times10^6$ psi (13.3 GPa) were taken as that for an FRP hollow tube having a thickness of 0.088 in. (2.23 mm) and a radius of 7 in.

$$A_{shell}=2\cdot\pi\cdot r\cdot t \tag{1}$$

$$I_{shell}=2\cdot\pi\cdot r^3\cdot t \tag{2}$$

The elastic modulus of the tube is calculated by transforming the elastic property of the lamina in the material principle axis, found in Table 1, to principle laminate axis.

TABLE 1

Properties of FRP Arch Tube Section used Buckling Analysis

| | FRP ArchTube | FRP Concrete Arch Tube |
|---|---|---|
| Type of Loading | Uniform Distributed Load | Concentrated Load at Midspan |
| Modulus of Elasticity Ksi - (GPa) | 1795 (12.37) | 1827 (12.60) |

TABLE 1-continued

Properties of FRP Arch Tube Section used Buckling Analysis

| | FRP ArchTube | FRP Concrete Arch Tube |
|---|---|---|
| Area $in^2$ - ($cm^2$) | 1.398 (9.0) | 39.2 (252.8) |
| Moment of Inertia $in^4$ - ($cm^4$) | 8.717 (362.8) | 53.75 (2,237) |

Elastic Property in Material Principal Axis $$Q_{12}=\begin{bmatrix}\frac{E_1}{1-\nu_{12}\cdot\nu_{21}} & \frac{\nu_{12}\cdot E_1}{1-\nu_{12}\cdot\nu_{21}} & 0\\ \frac{\nu_{21}\cdot E_2}{1-\nu_{12}\cdot\nu_{21}} & \frac{E_2}{1-\nu_{12}\cdot\nu_{21}} & 0\\ 0 & 0 & G_{12}\end{bmatrix} \tag{3}$$

Transformation Matrix $$T=\begin{bmatrix}m^2 & n^2 & -2\cdot m\cdot n\\ n^2 & m^2 & 2\cdot m\cdot n\\ m\cdot n & -m\cdot n & m^2-n^2\end{bmatrix} \tag{4}$$

Elastic Property in Laminate Principal Axis $$Q_{xy}=T^{-1}\cdot Q_{12}\cdot R\cdot T\cdot R^{-1} \tag{5}$$

$$R=\begin{bmatrix}1 & 0 & 0\\ 0 & 1 & 0\\ 0 & 0 & 2\end{bmatrix} \tag{6}$$

Where m=cos(θ), and n=sin(θ). Once the structural analysis is conducted, a critical section is selected and the maximum developed moment is obtained. The critical section is selected based on the maximum flexural force since the axial force transferred to the shell is minimal and is sustained by hydrostatic pressure.

After the internal forces are evaluated, the capacity of the FRP shell is checked against the developed stresses. Thin laminate analysis is assumed. The composite properties are obtained using classical laminate theory for orthotropic material. Bending stresses ($\sigma_b$), axial stresses $\sigma_a$, and shear stresses $\sigma_v$, resulting from developed internal forces are computed using simple elastic theory as follows:

$$\sigma_b=\left(\frac{Mc}{I_{shell}}\right) \tag{7}$$

$$\sigma_a=\left(\frac{P}{A_{shell}}\right) \tag{8}$$

$$\sigma_v=\left(\frac{VQ}{2I_{shell}t}\right) \tag{9}$$

Where M, P, and V are the applied moment, axial and shear forces, respectively; c is the distance from the neutral axis to the location where the stress is compute; $A_{shell}$ and $I_{shell}$ are the area and moment of inertia of the FRP tube respectively; t is the thickness of the shell; and Q is the first moment of inertia.

The moment and axial stresses are superimposed. The superimposed stresses along with the shear stresses are transformed from the principle laminate axis to the principle material axis and then checked against failure using Maximum Stress Theory. Stress calculation and failure check is done along the circumference of the shell simultaneously.

The variables used in the analysis are given in Table (2), and the calculations are automated using a computer program.

TABLE 2

Definition of Variables used in Moment-Curvature analysis

| Variable | Definition of Variables |
|---|---|
| PROPERTIES OF FRP TUBE | |
| E1 | Ply Modulus in Fiber Direction |
| E2 | Ply Modulus in Matrix Direction |
| G12 | Ply Shear Modulus |
| v12 | Ply Poisson's Ratio for Loading in the Fiber Direction |
| f1 | Ply Strength in Fiber Direction |
| f2 | Ply Strength in Matrix Direction |
| f12 | Ply Shear Strength |
| Ply Angle | Fiber Architecture |
| Ply Thickness | Thickness of Each Ply |
| PROPERTIES OF CONCRETE | |
| Ec | Concrete Modulus |
| Vo | Concrete Poisson's Ratio |
| f'c | Compressive Strength of Unconfined Concrete |
| eco | Ultimate Compressive Strain of Concrete |
| INTERNAL FORCES | |
| P | Applied Axial Load |
| V | Shear force |
| vs | Shear Span |

The computer program developed to facilitate the numerical calculations for this application can terminate either when the first ply undergoes failure in the direction of the fiber or when the shell has been proven to be adequate to sustain the applied forces. If the shell fails to withstand the developed stresses, the computer program generates: (1) the type of failure (fiber failure, matrix failure or shear failure), (2) the ply number where failure occurred, (3) the failure location in angles with respect to a vertical axis passing through the center and the top quadrant of the cross section, (4) and finally the strength ratio defined as the ultimate strength over the applied stress; otherwise, the program would state that the arched shell design is adequate For the current illustrative example, and using the values given in Table (3) it is found the shell can sustain the weight of the wet concrete.

TABLE 3

Data for FRP arch hollow tube analysis under wet concrete

FRP Properties
Elastic Properties (psi)

E1 = [5.49e6; 2.47e6];
E2 = [1.65e6; 2.47e6];
G12 = [4.80e5; 8.77e5];
V12 = [0.30; 0.40];
Ply Angles (degrees)
ang = [+45, −45, +45, −45, +45, −45];
Ply Thickness (inches)
thk = [0.0146; 0.0146; 0.0146; 0.0146; 0.0146; 0.0146];
Material Strength (psi)

| Material #1 | Material #2 | |
|---|---|---|
| Ft = [6.25e5 | 8.50e4 | Tensile in Fiber Direction |
| 8.81e3 | 8.54e3 | Tensile Perpendicular |
| 8.81e3 | 8.85e3]; | Shear |
| Fc = [6.25e5 | 8.50e4 | Comp. in Fiber Direct |
| 8.81e3 | 8.54e3 | Comp. Perpendicular |
| 8.81e3 | 8.85e3]; | Shear |

TABLE 3-continued

Data for FRP arch hollow tube analysis under wet concrete

Applied Load

M = 600; lb-in
P = 0; lb
V = 0; lb
Cross-Section Properties
Inner tube radius = 3.5 (inches)

2. Analysis of FRP Concrete Arch Tube Under a Concentrated Load Applied at Midspan An iterative method is used to calculate the ultimate vertical concentrated midspan load that the FRP-concrete arch can support. The iterative method incorporates the use of two numerical computer programs: (1) a moment-curvature program to calculate the moment capacity of an FRP-concrete cross-section and (2) a structural analysis program that calculates the internal developed forces based on a given structure model and load. A brief summary of the moment-curvature output and input variables is given first. An iterative method adopted for the analysis of the FRP-concrete specimens is described in detail. A flow-chart to aid in understanding the iterative procedure is also included.

The moment-curvature model input data is shown in Table 4, and the variables are defined in Table 1.

TABLE 4

Moment-Curvature Input Data for FRP-Concrete Arched Tube Analysis
(see Table 1 for Definition of Variables)

| E1 | E2 | G12 | v12 | f1 | f2 | f12 |
|---|---|---|---|---|---|---|
| 4.01e5 | 4.01e5 | 7.00e5 | 0.25 | 6.25e4 | 6.25e3 | 5.00e3 |

Ply Angles (6 plies)
45, −45, 45, −45, 45, −45
Ply Thicknesses
0.0146, 0.0146, 0.0146, 0.0146, 0.0146, 0.0146
Concrete Properties

| Ec | vo | f'c | eco | P | vs | vk |
|---|---|---|---|---|---|---|
| 4.90e6 | 0.20 | 6500.0 | −.003 | 0.0 | 28.0 | 3.5 |

Radius of Cross-section = 3.5
Angle for strain output = 180

All the values are given in English units, psi, inches, or lb. The number of layers and the number of material types are entered next. The elastic properties for each material are given in rows. The ply layup orientation, thickness and the material reference number for each ply follow. The ply layup and the materials are separated with commas. Concrete properties are given next: initial modulus, initial Poisson's ratio, unconfined strength, and strain at peak stress for unconfined concrete. The axial force, shear span, shear flag and shear constant ($v_k$) are listed next. The shear span is defined as the distant from the support to the nearest applied load for a four point bending test, or the distant for the support to the center of the beam for a three point bending test. The shear constant ($v_k$) is a parameter used in calculating the shear sustained by the concrete core ($Vc=v_k \cdot A \cdot \sqrt{f'_c}$). ACI recommends a ($v_k$) between 1.9 and 3.5 for psi unit. The cross-section radius is given afterwards. Lastly, the angle for the strain output is set. The angle is taken with respect to a vertical axis having the center of the cross-section as the origin. The axial hoop and shear strains are obtained as a function of the moment and shear load.

An iterative procedure is used to determine the concentrated load that could be carried by the FRP-concrete arch tube, as described next. The axial and shear force input into the moment-curvature analysis are initially assumed to be zero and the moment capacity and secant stiffness of the cross-section are generated. The neutral axis at the moment capacity is extracted from the analysis. The arch is analyzed using a commercial structural analysis program using a series of straight beam elements. The area, A, of the cross-section is taken as the sum of the transformed FRP shell, $A_{shell}$, and the uncracked concrete section, $A_{cr}$.

$$A=A_{cr}+A_{shell} \tag{10}$$

$$\text{Where } A_{shell}=(2\pi r\cdot t)\cdot n \tag{11}$$

$$\text{and } A_{cr}=r^2\cdot(\alpha-\sin(\alpha)\cdot\cos(\alpha)) \tag{12}$$

Where r is the radius of the circular cross-section, α is defined as $$\text{arc_cos}\left(\frac{r-c}{c}\right),$$

and c is the distance from the center of the cross-section to the neutral axis at moment capacity. In the same manner, the moment of inertia, I, are taken as the sum of the transformed shell inertia, $I_{shell}$ and the uncracked concrete inertia, $I_{cr}$.

$$I = I_{cr} + I_{shell} \tag{13}$$

$$I_{shell} = 2\cdot\pi\cdot r^3\cdot t \tag{14}$$

$$I_{cr} = \frac{r^4}{4}\cdot(\alpha-\sin(\alpha)\cdot\cos(\alpha)+2\cdot\sin(\alpha)^3\cdot\cos(\alpha)) \tag{15}$$

Figure 20:
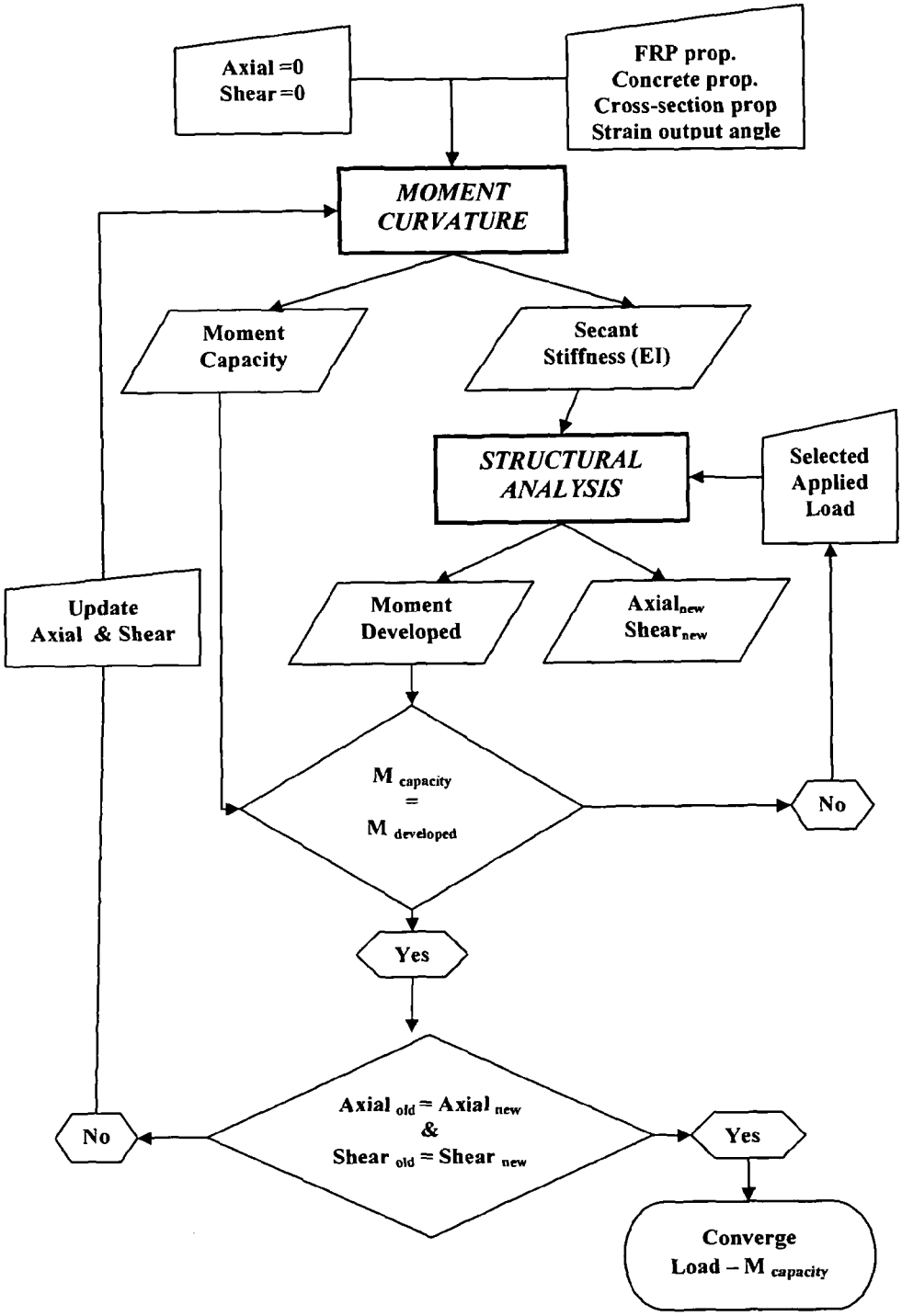
FIG. 20 is a schematic illustration of an FRP concrete arch tube analysis under a concentrated load.

The modulus of elasticity is calculated by dividing the secant stiffness (EI) generated by the moment curvature analysis by I. Once the material properties are calculated, an arbitrary concentrated load is applied vertically at midspan and structural analysis is conducted. The absolute value of the maximum moment is compared with that generated by the moment curvature analysis. The arbitrary load at midspan is altered until the maximum moment developed in the arch converged to the moment capacity of the cross-section. Once this was achieved, the axial and shear force at the section of maximum moment are reentered into the moment curvature program and a new moment capacity and secant stiffness are calculated. These values are used again in the structural analysis program and a new axial and shear forces are calculated. The process is repeated several times until the change in the shear and axial forces are small enough. A flow chart illustrating the iterative method is shown in FIG. 20.

After running the iterative method, it was found the FRP-concrete arch had a moment capacity of 40.3 ft-kip (54.6 m-kN) and a corresponding secant stiffness of 95000 ksi (655 GPa). The ultimate vertical load applied at midspan of the arch was found to be equal to 27 kips (12,272 kg).

3. FRP-Concrete Tubular Arch Buckling Analysis

The FRP arched tube is checked against global buckling under two loadings:

1. FRP arch tube under the weight of wet concrete
2. FRP concrete arch tube under a concentrated load applied at midspan.

For convenience, a computer may be used to expedite the calculations. Using virtual work for linearly elastic material, the following analysis minimizes the governing potential energy functional.

Figure 21:
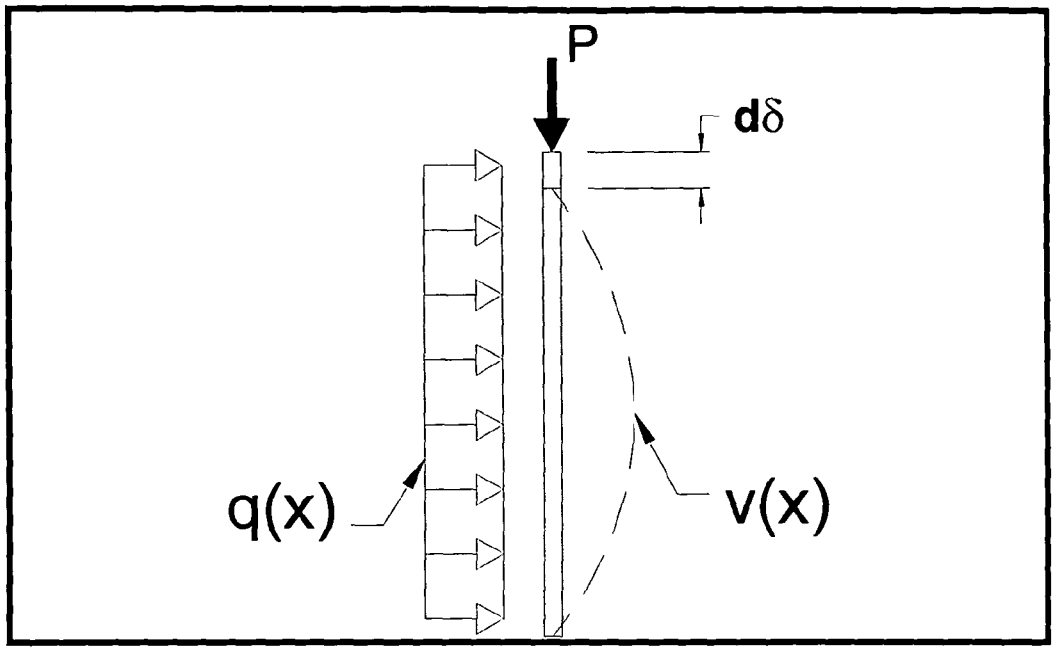
FIG. 21 is a schematic illustration describing a potential energy equation.

Potential Energy Equation:

$$\Pi = \frac{1}{2}\times\int_L EI\cdot\left(\frac{d^2v}{dx^2}\right)^2\cdot dx + \frac{1}{2}\times\int_L EA\cdot\left(\frac{du}{dx}\right)^2\cdot dx - \frac{P}{2}\times\int_L\left(\frac{dv}{dx}\right)^2\cdot dx - \int_L q(x)\cdot v(x)\cdot dx$$

Where EI is the flexural stiffness, EA is the axial stiffness, P is the critical buckling load, q(x) is the distributed load on the member, and v(x) is a set of cubic beam element shape functions, as shown in FIG. 21. The shape functions are defined as follows:

$$N_1 = \left[1-3\left(\frac{x}{L}\right)^2+2\left(\frac{x}{L}\right)^3\right] \tag{16}$$

$$N_2 = x\cdot\left[1-\left(\frac{x}{L}\right)\right]^2 \tag{17}$$

$$N_3 = 3\cdot\left(\frac{x}{L}\right)^2-2\cdot\left(\frac{x}{L}\right)^3 \tag{18}$$

$$N_4 = x\cdot\left[\left(\frac{x}{L}\right)^2-\left(\frac{x}{L}\right)\right] \tag{19}$$

The axial strain may be neglected and the distributed load q(x) is eliminated from the analysis. By minimizing the potential energy equation and equating it to zero, the elastic ($K_e$) and the geometric ($K_g$) stiffness matrix are deduced.

$$K_e = \begin{bmatrix} \frac{EA}{L} & 0 & 0 & -\frac{EA}{L} & 0 & 0 \\ 0 & 12\frac{EI}{L^3} & 6\frac{EI}{L^2} & 0 & -12\frac{EI}{L^3} & 6\frac{EI}{L^2} \\ -\frac{EA}{L} & 0 & 0 & \frac{EA}{L} & 0 & 0 \\ 0 & -12\frac{EI}{L^3} & -6\frac{EI}{L^2} & 0 & 12\frac{EI}{L^3} & -6\frac{EI}{L^2} \\ 0 & 6\frac{EI}{L^2} & 2\frac{EI}{L} & 0 & -6\frac{EI}{L^2} & 2\frac{EI}{L} \end{bmatrix} \tag{20}$$

$$K_g = \begin{bmatrix} 0 & 0 & 0 & 0 & 0 & 0 \\ 0 & \frac{6}{5L} & \frac{1}{10} & 0 & -\frac{6}{5L} & \frac{1}{10} \\ 0 & \frac{1}{10} & \frac{2L}{15} & 0 & -\frac{1}{10} & -\frac{L}{30} \\ 0 & 0 & 0 & 0 & 0 & 0 \\ 0 & -\frac{6}{5L} & -\frac{1}{10} & 0 & \frac{6}{5L} & -\frac{1}{10} \\ 0 & \frac{1}{10} & -\frac{L}{30} & 0 & -\frac{1}{10} & \frac{2L}{15} \end{bmatrix} \tag{21}$$

Figure 22:
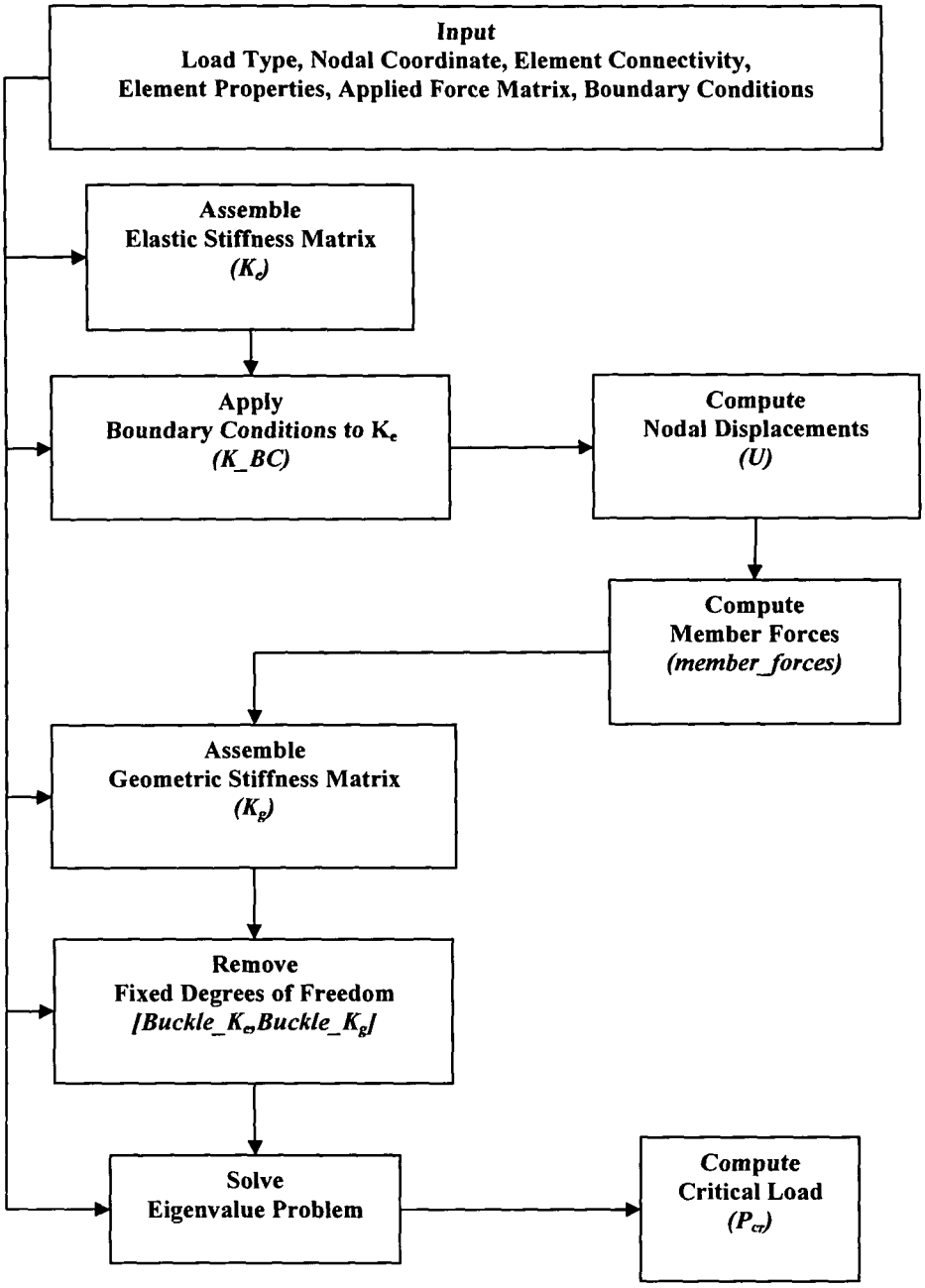
FIG. 22 is a flow chart for an arch global buckling analysis under weight of wet concrete or under a concentrated load, or other filler in liquid or flowing form.

The following analysis is performed (see FIG. 22): (1) assemble the global stiffness matrix, $K_e$ (2) apply boundary conditions to the stiffness matrix, K_BC, (3) compute nodal deflection $$\left(U = \frac{\text{K_BC}}{F}\right),$$

(4) compute member forces (5) assemble the geometric stiffness matrix, $K_g$, (6) reduce $K_e$ and $K_g$ to remove fixed displacement, and (7) solve the generalized eigenvalue problem and compute the critical load.

For the analysis of the illustrative problem at hand, it was found that the buckling load for the FRP arch tube subjected to a uniform distributed load is 56 lb/in . . . (1,002 kg/m) while the buckling load of the FRP-concrete arch tube subjected to a concentrated load at midspan is 75 kips (34,090 kg). To calculate the critical buckling load due to the weight of wet concrete, a uniform distributed unit force is applied vertically at each node. It is found that the buckling load was 56 lb/in (1,002 kg/m), which is greater than the distributed weight of wet concrete, 46.75 lb/in. (836 kg/m), in a 3.5 in. (89 mm) radius FRP tube. Similarly, to calculate the critical buckling load for a load applied vertically at midspan, a unit force is applied at midspan. It is found that buckling load was 75 kips (34,090 kg) while the load to be carried by the FRP concrete arch tube found earlier is 27 kips (12,270 kg). Accordingly, the FRP arch tube used in this example would not be subjected to global buckling under the two load cases.

Local Wall Buckling Analysis of the FRP Hollow Tube

The last type of analysis illustrated on the FRP arch tube system is local buckling under axial compression. A set of equations using elastic shell buckling, as a simplified approximate method, are used:

$$z = 2\cdot\left(\frac{L}{D}\right)^2\cdot\left(\frac{D}{t}\right)\cdot\sqrt{1-v^2} \tag{21}$$

if $$z \geq \frac{1.2\cdot(D/t)^2}{C} \tag{22}$$

Axial Stress $$\sigma_{xc} = \frac{\pi^2\cdot E}{\left(\frac{L}{r}\right)^2} \tag{23}$$

Bending Stress $$\sigma_{ce} = 2\frac{C\cdot E}{\frac{D}{t}} \tag{24}$$

Where L is the length of the cylinder, D is the cross-section diameter measure from the center of the shell thickness, t is the thickness of the shell, r is the radius of gyration, v and E is the Poisson's ratio and elastic modulus of the material, respectively, C is taken as 0.0165.

For the illustrative problem shown herein, it is found that the developed stresses resulting from the weight of wet concrete would not result in local buckling in the FRP tube. The moment, 214 lb-ft (290.2 m-N) and axial, 468 lb (212.7 kg) forces used for the buckling analysis are the maximum forces produced in the arch at any given location, respectively, which is a conservative approach.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A load resisting system comprising:

a plurality of arched tubular structural members formed of a fiber-reinforced polymer material defining a hollow interior, each tubular structural member being substantially oriented in a plane and connected to an adjacent tubular structural member, wherein each hollow tubular structural member has a moment capacity;

wherein the interior of each tubular structural member is at least partially filled with at least one reinforcing material selected from the group consisting of non-shrink concrete, expansive concrete, non-shrink grout, and expansive grout; the reinforced tubular structural member having a moment capacity when filled and cured at least one order of magnitude greater than the moment capacity of the hollow tubular structural member.

2. The load resisting system of claim 1, wherein the reinforced tubular structural member has a moment capacity when filled and cured at least two orders of magnitude greater than the moment capacity of the unfilled hollow tubular structural member.

3. The load resisting system of claim 1, wherein each tubular structural member includes at least one opening near a top portion of the tubular structural member, the opening providing access to the hollow interior for filling with a reinforcing material on site.

4. The load resisting system of claim 1, wherein each of the plurality of tubular structural members is substantially oriented in a plane and the planes defined by the tubular structural members are substantially parallel.

5. The load resisting system of claim 4, wherein the tubular structural members are spaced at a calculated distance from one another as necessary to carry the design dead and live loads.

6. The load resisting system of claim 1, wherein the tubular structural members are connected in a transverse direction using substantially horizontal rods fitted through transverse holes spaced along the length of each tubular support member.

7. The load resisting system of claim 1, further comprising lateral force resisting members for transferring vertical loads to the tubular structural members.

8. The load resisting system of claim 7, wherein the lateral force resisting members comprise sheets interconnecting at least two adjacent tubular structural members.

9. The load resisting system of claim 8, wherein the sheets of the lateral force resisting members are formed from one of metal, polymer, and fiber-reinforced polymer.

10. The load resisting system of claim 8, wherein the sheets of the lateral force resisting members are formed from wood-plastic composite.

11. The load resisting system of claim 8, wherein the lateral force resisting sheets are secured to the tubular structural members by a plurality of fasteners which extend into the reinforcing material in tubular structural members.

12. The load resisting system of claim 8, wherein the lateral force resisting sheets include corrugations that run in a direction substantially perpendicular to the planes defined by the tubular structural members.

13. The load resisting system of claim 1, wherein the tubular support members are covered with a flexible fabric such as a geotextile.

14. The load resisting system of claim 1, wherein the load resisting system comprises at least one of a short-span buried bridge, underground storage facility and tunnel structure.

15. The load resisting system of claim 1, wherein the filled, reinforced tubular structural members have a moment capacity at least about 40 ft-kips.

16. A load resisting system comprising:

a plurality of arched tubular structural members formed of a fiber-reinforced polymer material defining a hollow interior, each tubular structural member being substantially oriented in a plane and connected to an adjacent tubular structural member, wherein each hollow tubular structural member has a moment capacity;

wherein the interior of each tubular structural member is at least partially filled with at least one reinforcing material selected from the group consisting of non-shrink concrete, expansive concrete, non-shrink grout, and expansive grout;

wherein the reinforced tubular structural member has a moment capacity when filled and cured at least one order of magnitude greater than the moment capacity of the hollow tubular structural member; and wherein the plurality of arched tubular structural support members is adapted for use as a bridge.

17. The load resisting system of claim 16, wherein the plurality of arched tubular structural support members is adapted for use as a buried bridge.

18. The load resisting system of claim 16, wherein the plurality of arched tubular structural support members is further adapted for use as one of an underground storage facility, a tunnel, a hanger, and a bunker.

19. A load resisting system comprising:

a plurality of arched tubular structural members formed of a fiber-reinforced polymer material defining a hollow interior, each tubular structural member being substantially oriented in a plane and connected to an adjacent tubular structural member, wherein each hollow tubular structural member has a moment capacity;

wherein the interior of each tubular structural member is at least partially filled with at least one reinforcing material selected from the group consisting of non-shrink concrete, expansive concrete, non-shrink grout, and expansive grout;

wherein the reinforced tubular structural member has a moment capacity when filled and cured at least one order of magnitude greater than the moment capacity of the hollow tubular structural member; and wherein the plurality of arched tubular structural support members is covered with geotextile material adapted to support one of a natural and a man-made back fill material.

* * * * *